US005993272A

United States Patent [19]

Wood et al.

[11] Patent Number: 5,993,272

[45] Date of Patent: Nov. 30, 1999

[54] ELECTRICAL CONNECTOR HAVING DETACHABLE WIRE CONNECTION AT CABLE ENTRY END

[75] Inventors: Richard G. Wood, Magnolia; Joe N. Wood, Sugarland, both of Tex.

[73] Assignee: Tescorp Seismic Products, Inc., Stafford, Tex.

[21] Appl. No.: 09/081,698

[22] Filed: May 20, 1998

[51] Int. Cl.[6] ..... H01R 13/02

[52] U.S. Cl. ..... 439/891; 439/805

[58] Field of Search ..... 439/891, 805

[56] References Cited

U.S. PATENT DOCUMENTS

| | | | |
|---|---|---|---|
| 2,866,957 | 12/1958 | Raypholtz | 439/246 |
| 2,988,725 | 6/1961 | Valee | 439/556 |
| 3,517,373 | 6/1970 | Jamon | 439/274 |
| 3,888,559 | 6/1975 | Geib . | |
| 3,897,131 | 7/1975 | Stauffer | 439/889 |
| 3,937,545 | 2/1976 | Cairns et al. . | |
| 4,090,759 | 5/1978 | Herrmann, Jr. . | |
| 4,150,866 | 4/1979 | Snyder, Jr. et al. . | |
| 4,355,855 | 10/1982 | Rebikoff . | |
| 4,397,517 | 8/1983 | Shaffer | 439/891 |
| 4,588,247 | 5/1986 | Grappe et al. . | |
| 4,632,482 | 12/1986 | Punako et al. . | |
| 5,145,410 | 9/1992 | Mrjima et al. | 439/387 |
| 5,529,518 | 6/1996 | Wood | 439/843 |
| 5,595,497 | 1/1997 | Wood | 439/282 |
| 5,711,685 | 1/1998 | Wood | 439/587 |

*Primary Examiner*—Neil Abrams
*Attorney, Agent, or Firm*—Jenkens & Gilchrist

[57] ABSTRACT

A detachable coupling member (30) at the cable entry end (16) of an electrical connector (10) provides easily removable attachment of the individual wires (54) of a cable assembly to the electrical connector (40). The detachable coupling member (30) permits the conventional solder connection of a wire (54) to an electrically conductive element (32) of the connector (10) to be made at a position spaced from portions (12) of the connector assembly (10) that may be damaged by heat generated in the course of making the solder connection, and provides selective attachment or separation of the wire (54) and connector (10). In use, the wires (54) are joined to the coupling members (30) which are to be plugged into sockets (27) at the rear of contacts (22) and held in place by use of threaded sleeves (42) to permit easy removal of faulty or incorrectly attached wires.

8 Claims, 1 Drawing Sheet

ELECTRICAL CONNECTOR HAVING DETACHABLE WIRE CONNECTION AT CABLE ENTRY END

BACKGROUND OF THE INVENTION

1. Technical Field

This invention relates generally to an electrical connector assembly having a contact member imbedded therein and which has a portion extending outwardly from a cable entry end of the connector, and more particularly to such an electrical connector to which a wire can be detachably connected to the portion of the conductor extending outwardly from the connector.

2. History of Related Art

Electrical connection between the individual wires of a multi-wire cable and the corresponding electrical contacts carried within a connector attached to the cable, are typically made by solder joints. Solder joints not only provide good electrical communication between the wires and the respective contacts, but also provide good physical connection between the two members. For example, the electrical contacts imbedded within in an electrically non-conductive body, as disclosed in U.S. Pat. No. 5,711,685 issued Jan. 27, 1998 to Richard G. Wood, the inventor of the present invention, are made by solder attachment of the wires to a solder lug formed on the end of each of the contacts.

However, solder connections between the electrically conductive wires and the contact member of a connector assembly presents several problems. First, it is frequently difficult to make good solder connections between the wires and the contacts of the connector when there are a large number of closely positioned contact members in the connector. Secondly, the heat required to melt solder and make the joint may be damaging to a surrounding sheath at the cable end of the contact, as illustrated in the above-referenced patent, or even damage the seal between lands and grooves of the contact member and the body of the connector. Moreover, if it is subsequently discovered that one of the wire leads is faulty, and the wire is connected to a contact member positioned in the middle of a large number of other contact members, it is extremely difficult to desolder the wire without damaging the solder connection of adjacently positioned wires. Also, if one of the wire conductors is faulty or connected in error to the wrong contact, it is generally difficult to correct the fault or error and rewire a wire conductor to another contact member.

The present invention is directed to overcoming the problems set forth above. It is desirable to have an electrical connector in which the individual contacts within the connector are detachably connected to respective wires of a cable to which the connector is attached. It is also desirable to have such an electrical connector, and electrical contacts disposed within the connector, which do not require direct soldering to the cable entry end of the contact. Furthermore, it is desirable to have such an electrical connector in which wiring errors, or damaged wire circuits can be replaced or rerouted without requiring solder joint melting for removal of the faulty attachment.

SUMMARY OF THE INVENTION

In accordance with one aspect of the present invention, an electrical contact assembly for use in a connector body includes an electrically conductive contact member and a detachable coupling member. The electrically conductive contact member has first end, a second end, and a centrally disposed middle portion. The first end of the electrically conductive contact member is adapted for connection to a mating structure to provide electrical connection therebetween, the middle portion is disposed within the connector body, and the second end of the electrically conductive contact member is adapted for attachment to the detachable coupling member. The detachable coupling member has a first end that is adapted for joining to the second end of the contact member, and a second end adapted for attachment to a wire conductor.

Other features of the electrical contact assembly, embodying the present invention, include the second end of the detachable coupling member being a soldering lug. Other features include the second end of the contact member having a socket centrally disposed therein and the first end of the detachable coupling member having a pin adapted to engage the socket and provide electrical communication therebetween.

Still other features of the electrical contact assembly, embodying the present invention, include the assembly having a threaded sleeve in which internally disposed threads are formed to engage externally disposed threads formed on the second end of the contact member and selectively secure the detachable coupling to the second end of the contact member.

In accordance with another aspect of the present invention, an electrical connector assembly includes a core, an electrically conductive contact member, and a detachable coupling member. The core has a mating end and a cable entry end, wherein the cable entry end has a transverse wall. The electrically conductive contact member has a first end, a second end, and a centrally disposed middle portion. The first end of the electrically conductive contact member extends outwardly from the mating end of the core and is adapted for connection with a predefined mating structure to provide electrical connection therebetween. The middle portion of the electrically conductive contact member is disposed within the core. The second end of the electrically conductive contact member is adapted for attachment to the coupling member. The detachable coupling member has a first end adapted for joining to the second end of the contact member, and a second end adapted for attachment to a wire conductor.

Other features of the electrical connector assembly embodying the present invention include the transverse wall of the core having at least one sheath extending outwardly from the transverse wall and the second end of the detachable coupling having a soldering lug formed thereon. Still other features include the second end of the contact member of the electrical connector assembly having a socket centrally disposed therein and the first end of the detachable coupling having a pin adapted to engage the socket and provide electrical communication therebetween.

Still other features of the electrical connector assembly embodying the present invention include the electrical connector having a threaded sleeve with internally disposed threads adapted to engage externally disposed threads on the second end of the contact member and arranged to selectively secure the detachable coupling to the second end of the contact member.

BRIEF DESCRIPTION OF THE DRAWINGS

A more complete understanding of the structure and operation of the present invention may be had by reference to the following description when taken in conjunction with the accompanying drawings, wherein.

DETAILED DESCRIPTION OF A PRESENTLY PREFERRED EXEMPLARY EMBODIMENT

Figure 1:
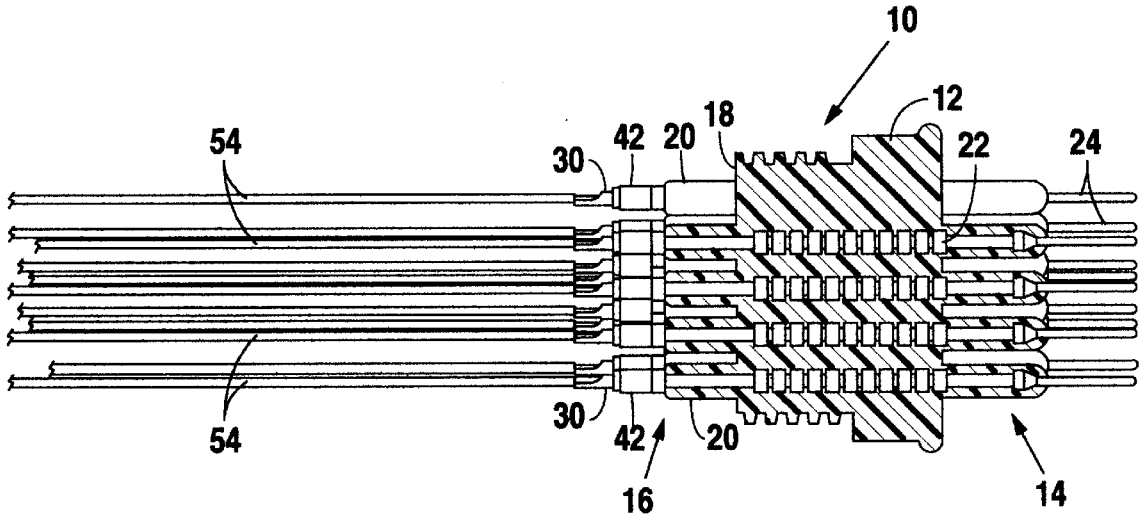
FIG. 1 is a cross-sectional view of an electrical connector embodying the present invention.
Figure 2:
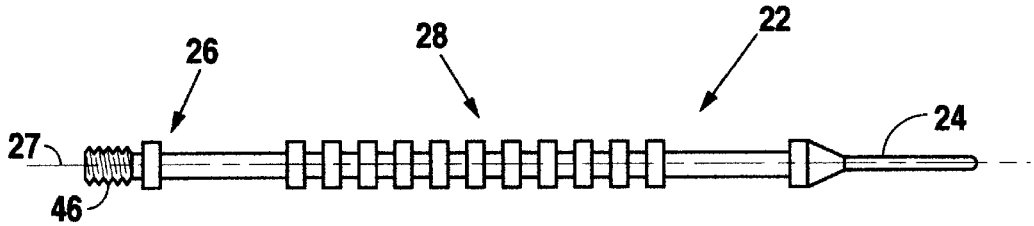
FIG. 2 is an elevational view of an electrical contact assembly embodying the present invention and is a member of the electrical connector shown in FIG. 1.

In the preferred embodiment of the present invention, an electrical connector assembly 10 includes a molded core 12 that has a mating end 14 and a cable entry end 16. The cable entry end 16 of the molded core 12 has a transverse wall 18 from which, in the illustrated embodiment, a plurality of sheaths 20 extend outwardly from the transverse wall 18. The molded core 12 is preferably formed of an electrically non-conductive thermoplastic resin such as urethane, polyethylene, neoprene rubber, injection moldable glass-filled urethane, or mixtures and combinations thereof.

The electrical connector assembly 10 also includes an electrically conductive contact member 22 having a first end 24, a second end 26, and a middle portion 28. The middle portion 28 of the contact member 22 has a plurality of lands and grooves on an outer surface of the contact member 22 and is completely imbedded and surrounded by the molded core 12. The lands and grooves defined on the middle portion 28 of the contact member 22 aid in retention of the contact member 22 within the core 12 and, provide a labyrinth seal between the contact member 22 and the core 12. Typically, when the core member 12 of the connector 10 is molded, upon solidification of the molten material, some shrinkage will occur which assures tight sealing between the core 12 and the contact member 22.

The contact member 22 is formed of an electrically conductive material. When used in adverse environments, such as underwater electrical connectors, the contact member 22 should also be corrosion resistant. Desirably, the contact member 22 is formed of beryllium copper.

The first end 24 of the electrically conductive contact member 22 is adapted for connection with a mating connector and may either be in the form of a pin, as shown in the illustrated embodiment, or a socket arranged to receive a pin. In the exemplary embodiment, the second end 26 of the contact member 22 is at least partially imbedded within a respective one of the sheaths 20 that extend from the transverse wall 18 of the molded core 12. The second end 26 of the contact member 22 also is adapted for attachment to a coupling member such as a pin, socket, clip, or other electrically conductive detachable coupling.

Figure 3:
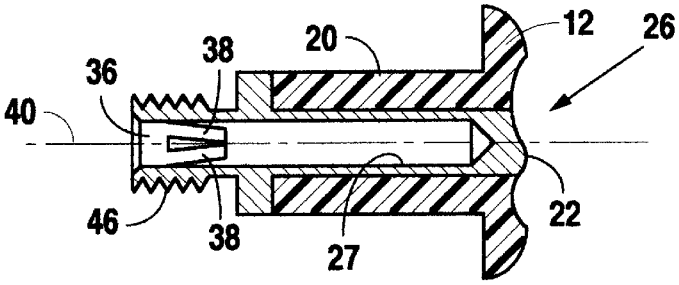
FIG. 3 is an enlarged cross-sectional view of a second end of the electrical contact shown in FIG. 2.
Figure 4:
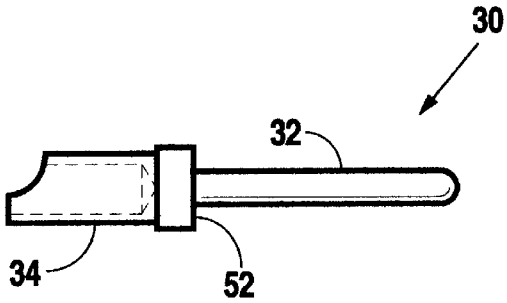
FIG. 4 is an elevational view of a detachable coupling member of an electrical contact assembly, as shown in FIG. 1 and embodying the present invention.

In the preferred embodiment of the present invention, the electrical connector assembly 10 includes a detachable coupling member 30, as best shown in FIG. 4, having a first end 32 and a second end 34. The first end 32 of the detachable coupling member 30 is adapted for electrical connection to the second end 26 of the contact member 22. In the illustrated embodiment, the first end 32 of the detachable coupling member 30 is a pin that is insertable into a socket provided in the second end 26 of the contact member 22. As illustrated in FIG. 3, the socket 27 preferably has an electrically conductive cylindrical insert 36 pressed into the open end of the socket 27. The insert 36 has a plurality of circumferentially spaced-apart fingers 38 that are biased radially inwardly toward a longitudinal axis 40 of the socket 27. The insert 36, assures positive electrical connection between the pin formed on the first end 32 of the detachable coupling member 30 and the socket 27 formed in the second end 26 of the contact member 22.

Figure 5:
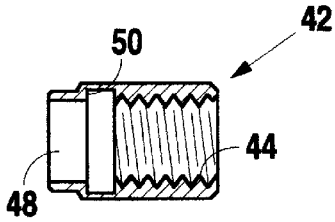
FIG. 5 is a threaded sleeve member of the electrical contact assembly shown in FIG. 1, and adapted to selectively secure the detachable coupling shown in FIG. 4 to the second end of the contact member shown in FIGS. 2 and 3.

The electrical connector assembly 10 also includes a threaded sleeve 42, as best shown in FIG. 5, which includes a plurality of internally disposed threads 44 that are adapted to engage a plurality of externally disposed threads 46 formed on the second end 26 of the contact member 22. The threaded sleeve 42 has a smooth bore end portion 48 with an internal diameter sized to closely surround the second end 34 of the detachable coupling member, and a radially inwardly extending shoulder 50 positioned between the internal threads 44 and the smooth bore end portion 48 that is arranged to abut a radially outwardly extending shoulder 52 disposed between the first and second ends 32, 34 of the detachable coupling member 30.

In the illustrated preferred embodiment, the second end 34 of the detachable coupling member is a conventional soldering lug, although other forms of wire connection, such as a crimped connection, may be provided at the second 34 of the detachable coupling member 30 if so desired.

When assembling a cable to the electrical connector assembly 10, the threaded sleeve 42 is installed over the second 34 of the detachable coupling member and moved toward the first end 32 of the coupling member 30 until the internal shoulder 50 of the threaded sleeve 42 abuts the external shoulder 52 of the detachable coupling member 30. A selected wire 54 of a cable assembly is then soldered to the second end 34 of the detachable coupling member 30. The first end 32 of the detachable coupling member 30 is then inserted into the socket 27 of the second end 26 of the contact member 22 and the threaded end of the sleeve 42 screwed onto the externally disposed threads 46 at the second end 26 of the contact member 22. Desirably, the external surface of the threaded sleeve 42 has a plurality of externally disposed flat surfaces equidistantly arranged circumferentially around the sleeve 42 to provide a gripping surface for a small wrench to tighten the threaded sleeve onto the contact member 22, with the detachable coupling member 30 captured therebetween.

Thus, it can be seen that the solder joint is advantageously made with the soldering lug while the lug is in a thermally non-conductive relationship with respect to other members of the connector assembly. This prevents potential melting of the sheath 20 surrounding the second end 26 of the contact member 22 and portions of the core 12 surrounding the middle portion 28 of the contact member 22. Moreover, if there is an error in connecting a particular wire 54 to a specific contact member 22, that error can be easily reversed by unthreading the sleeve 42 from the misconnected contact 22, removing the detachable coupling 30 from the incorrect contact member 22, and then connecting the detachable coupling member 30 to the correct contact member 22. This feature is particularly advantageous in cable-connector applications in adverse environmental applications. For example, if a wire of a cable-connector assembly should be damaged, it is generally necessary to remove the cable-connector assembly from use and transport it to a repair facility having adequate repair capabilities. In a cable-connector assembly having the connector 10 embodying the present invention, repair of the damaged cable assembly may be as simple as disconnecting the damaged wire 54 and replacing it with a spare wire in the cable.

In other embodiments of the present invention, the core 12 may be separately formed, such as by molding or other forming methods, prior to assembly with the electrically conductive contact member 22. In such alternate embodiments, it may be desirable for the middle portion 28 of the contact member 22 to have a constant diameter external surface instead of the land and groove surface described above.

The electrical connector assembly 10, embodying the present invention, further provides a detachable coupling member 30 between the wire 54 of a cable and the contact member 22 of the connector assembly 10 which has an outer diameter that is not significantly greater than that of the contact member 22. This enables the use of a waterproof tube to be drawn up over the solder connection, or a one-piece seal structure to be installed at the cable entry end of the connector, to provide a waterproof connection between the individual wires 54 of the cable and the contact members 22. Such cable entry end seal arrangements are described in the aforementioned U.S. Patent issued to the inventor of the present invention.

Although the present invention is described in terms of a preferred exemplary embodiment with specific examples of wire connection arrangements, those skilled in the art will recognize that changes in those arrangements may be made without departing from the spirit of the present invention. Such changes are intended to fall within the scope of the following claims. Other aspects, features, and advantages of the present invention may be obtained from a study of this disclosure and the drawings, along with the appended claims.

What I claim is:

1. An electrical contact assembly for use in a connector body, comprising:

an electrically conductive contact member having a first end, a second end, and a centrally disposed middle portion, said first end being adapted for connection to a predefined mating structure to provide electrical connection therebetween, said middle portion being disposed within said connector body, and said second end being adapted for attachment to a coupling member and having a socket centrally disposed therein and a plurality of externally disposed threads formed thereon;

a detachable coupling member having a first end adapted for joining to the second end of said contact member and includes a pin adapted to engage said socket disposed in the second end of the contact member and provide electrical communication therebetween, and a second end adapted for attachment to a wire conductor and has a soldering lug disposed thereon; and a threaded sleeve having internally disposed threads adapted to engage the externally disposed threads on said second end of the contact member and arranged to selectively secure the detachable coupling member to the second end of said contact member.

2. An electrical contact assembly, as set forth in claim 1, wherein said socket centrally disposed in the second end of said contact member includes an electrically conductive cylindrical insert disposed within said socket, said insert having a plurality of circumferentially spaced apart fingers that are biased radially inwardly toward a longitudinal axis of said socket.

3. An electrical contact assembly as set forth in claim 1, wherein said middle portion of the electrically conductive contact member has a plurality of lands and grooves externally defined thereon.

4. An electrical connector assembly, comprising:

a core having a mating end and a cable entry end, said cable entry end having a transverse wall;

an electrically conductive contact member having a first end, a second end, and a centrally disposed middle portion, said first end extending outwardly from said mating end of the core and adapted for connection with a predefined mating structure to provide electrical connection therebetween, said middle portion being disposed within said core, and said second end extending outwardly from the transverse wall of said molded core and having a socket centrally disposed therein and a plurality of externally disposed threads formed thereon;

a detachable coupling member having a first end adapted for joining to the second end of said contact member and includes a pin adapted to engage said socket disposed in the second end of the contact member and provide electrical communication therebetween, and a second end adapted for attachment to a wire conductor and has a soldering lug disposed thereon; and a threaded sleeve having internally disposed threads adapted to engage the externally disposed threads on said second end of the contact member and arranged to selectively secure the detachable coupling member to the second end of said contact member.

5. An electrical connector assembly, as set forth in claim 4, wherein said transverse wall of the molded core has at least one sheath extending outwardly from said transverse wall in surrounding relationship with a portion of the second end of the electrically conductive contact member.

6. An electrical connector assembly, as set forth in claim 4, wherein said socket centrally disposed in the second end of said contact member includes an electrically conductive cylindrical insert disposed within said socket, said insert having a plurality of circumferentially spaced apart fingers that are biased radially inwardly toward a longitudinal axis of said socket.

7. An electrical connector assembly, as set forth in claim 4, wherein said core is molded and is formed of an electrically non-conductive thermoplastic resin, and said middle portion of the electrically conductive contact member is embedded within said molded core.

8. An electrical connector assembly, as set forth in claim 7, wherein said middle portion of the electrically conductive contract member has a plurality of lands and grooves externally defined thereon.

* * * * *

UNITED STATES PATENT AND TRADEMARK OFFICE

CERTIFICATE OF CORRECTION

PATENT NO : 5,993,272

DATED : November 30, 1999

INVENTOR(S) : Wood et al.

It is certified that error appears in the above-identified patent and that said Letters Patent are hereby corrected as shown below:

[57] Abstract, line 4 Replace "(40)"
With --(10)--

Signed and Sealed this

Tenth Day of April, 2001

*Attest:*

Nicholas P. Godici

NICHOLAS P. GODICI

*Attesting Officer*

*Acting Director of the United States Patent and Trademark Office*